US009910372B2

(12) United States Patent
Iguchi et al.

(10) Patent No.: US 9,910,372 B2
(45) Date of Patent: Mar. 6, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Moegi Iguchi, Kanagawa (JP); Sakon Takahashi, Kanagawa (JP); Takeshi Tanabe, Kanagawa (JP); Hiroshi Kamada, Kanagawa (JP); Yasuaki Hashimoto, Kanagawa (JP); Masaaki Usami, Kanagawa (JP); Yuka Zenitani, Kanagawa (JP); Yuta Saeki, Kanagawa (JP); Hiroaki Saijo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/335,972

(22) Filed: Oct. 27, 2016

(65) Prior Publication Data

US 2017/0315459 A1 Nov. 2, 2017

(30) Foreign Application Priority Data

Apr. 28, 2016 (JP) ..... 2016-091268

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |
| ***G03G 9/107*** | (2006.01) |
| ***G03G 9/113*** | (2006.01) |
| ***G03G 15/08*** | (2006.01) |

(52) U.S. Cl.

CPC ..... *G03G 9/0819* (2013.01); *G03G 9/0808* (2013.01); *G03G 9/0827* (2013.01); *G03G 9/08755* (2013.01); *G03G 9/0918* (2013.01); *G03G 9/1075* (2013.01); *G03G 9/1133* (2013.01); *G03G 15/0865* (2013.01)

(58) Field of Classification Search

CPC ..... G03G 9/09725; G03G 9/09708; G03G 9/08755

See application file for complete search history.

(56) References Cited

U.S. PATENT DOCUMENTS

2012/0045716 A1* 2/2012 Imamura ..... G03G 9/0819 430/105
2014/0017607 A1* 1/2014 Iida ..... G03G 9/08 430/108.6

FOREIGN PATENT DOCUMENTS

JP 2011-186402 A 9/2011
JP 5289024 B2 9/2013

* cited by examiner

*Primary Examiner* — Peter Vajda
(74) *Attorney, Agent, or Firm* — Oliff PLC

(57) ABSTRACT

An electrostatic charge image developing toner includes: toner particles; first silica particles having an average circularity of 0.9 to 1.0, a particle size distribution index of 1.05 to 1.25, and a compression aggregation degree of 60% to 95%; and second silica particles having an average circularity of 0.9 to 1.0, a particle size distribution index of 1.05 to 1.25, and a compression aggregation degree of 60% to 95%, wherein, when an average primary particle diameter of the first silica particles is set as Da (nm) and an average primary particle diameter of the second silica particles is set as Db (nm), relationships of the following Expressions (A1) to (A3) are satisfied: Expression (A1): $80 \leq Da \leq 120$, Expression (A2): $120 \leq Db \leq 200$, and Expression (A3): $10 \leq Db - Da \leq 120$.

18 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-091268 filed Apr. 28, 2016.

BACKGROUND

1. Technical Field

The present invention relates to an electrostatic charge image developing toner, an electrostatic charge image developer, and a toner cartridge.

2. Related Art

In electrophotographic image forming, toners are used as image forming materials, and, for example, a toner including toner particles containing a binder resin and a colorant, and an external additive that is externally added to the toner particles is widely used.

SUMMARY

According to an aspect of the invention, there is provided an electrostatic charge image developing toner including:

toner particles;

first silica particles having an average circularity of 0.9 to 1.0, a particle size distribution index of 1.05 to 1.25, and a compression aggregation degree of 60% to 95%; and second silica particles having an average circularity of 0.9 to 1.0, a particle size distribution index of 1.05 to 1.25, and a compression aggregation degree of 60% to 95%, wherein, when an average primary particle diameter of the first silica particles is set as Da (nm) and an average primary particle diameter of the second silica particles is set as Db (nm), relationships of the following Expressions (A1) to (A3) are satisfied:

$$80 \leq Da \leq 120, \quad \text{Expression (A1)}$$

$$120 \leq Db \leq 200, \text{ and} \quad \text{Expression (A2)}$$

$$10 \leq Db - Da \leq 120. \quad \text{Expression (A3)}$$

BRIEF DESCRIPTION OF THE DRAWINGS

Exemplary embodiments of the present invention will be described in detail based on the following figures, wherein.

DETAILED DESCRIPTION

Figure 1:
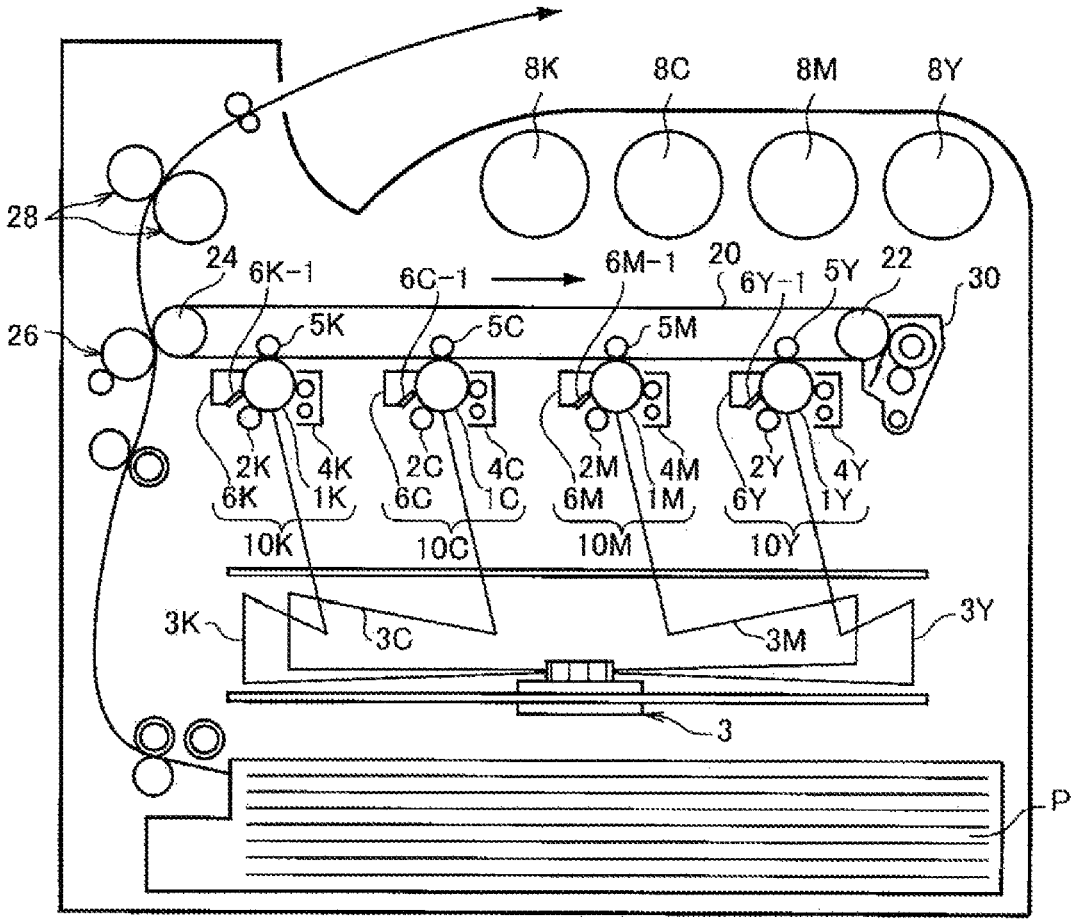
FIG. 1 is a schematic configuration diagram showing an image forming apparatus according to this exemplary embodiment.

Hereinafter, exemplary embodiments which are examples of the invention will be described.

Electrostatic Charge Image Developing Toner

An electrostatic charge image developing toner (hereinafter, also simply referred to as a "toner") according to this exemplary embodiment includes toner particles, first silica particles having an average circularity of 0.9 to 1.0, a particle size distribution index of 1.05 to 1.25, and a compression aggregation degree of 60% to 95%, and second silica particles having an average circularity of 0.9 to 1.0, a particle size distribution index of 1.05 to 1.25, and a compression aggregation degree of 60% to 95%.

When an average primary particle diameter of the first silica particles is set as Da (nm) and an average primary particle diameter of the second silica particles is set as Db (nm), relationships of the following Expressions (A1) to (A3) are satisfied.

$$80 \leq Da \leq 120 \quad \text{Expression (A1)}$$

$$120 \leq Db \leq 200 \quad \text{Expression (A2)}$$

$$10 \leq Db - Da \leq 120 \quad \text{Expression (A3)}$$

With the configuration described above, the toner according to this exemplary embodiment prevents passing of a toner from a cleaning nip portion (contact portion between a cleaning blade and an image holding member) occurring when an image having a high image density (for example, image density equal to or greater than 30%) is repeatedly formed, after forming images having a low image density (for example, image density equal to or smaller than 3%) in a high temperature and high humidity environment (for example, in the environment of a temperature equal to or higher than 28° C. and 85% RH). The reasons thereof are assumed as follows.

In the related art, in the electrophotographic image forming apparatus, a system of cleaning an untransferred toner remaining on an image holding member by using a cleaning blade (hereinafter, also referred to as a "blade") is used. This cleaning system is a system in which a blade having electricity contacts with an image holding member and a toner in a contact portion between a cleaning blade and an image holding member (cleaning nip portion) is scraped. When cleaning performance (that is, toner scraping performance) is poor, passing of a toner may occur. The passing of a toner appears as streak-shaped image defects (color streaks and the like).

Meanwhile, when a toner in which silica particles are externally added to toner particles is used, the externally added silica particles are isolated from the toner particles due to mechanical loads by stirring performed in a developing unit and scraping in the cleaning nip portion. The isolated silica particles approach the cleaning nip portion, the isolated silica particles are dammed up at a front end of the cleaning nip portion (portion on a downstream side of the contact portion between the blade and the image holding member in an image holding member rotating direction) and an aggregate (hereinafter, also referred to as an "externally added dam") aggregated due to pressure from the blade is formed. Cleaning performance (toner scraping performance) is improved due to this externally added dam. Therefore, occurrence of the passing of the toner from the cleaning nip portion is prevented.

However, in a case where a toner in which silica particles having a small diameter (silica particles having an average primary particle diameter smaller than 80 nm) are externally added to toner particles is used, when an image having a high image density is formed, after repeatedly forming images having a low image density in the high temperature and high humidity environment, the passing of the toner from the cleaning nip portion may occur due to poor cleaning performance (toner scraping performance). The reasons of this occurrence are considered as follows.

When images having a low image density are repeatedly formed in the high temperature and high humidity environment, the toner is rarely replaced in the developing unit, the same toner continuously receives mechanical loads, and silica particles having a small diameter are easily embedded in the toner particles. An amount of the silica particles supplied to (approaching) the front end of the cleaning nip portion is decreased due to the embedding of the silica particles having a small diameter, a porosity of the externally added dam is increased, and accordingly, strength of the externally added dam is decreased. When an image having a high image density having a large amount of the untransferred toner remaining on the image holding member is formed in a state with a small amount of the externally added dam and low strength, a large amount of the untransferred toner approaches the cleaning nip portion, the externally added dam may be broken, and the passing of the toner from the cleaning nip portion may occur.

Meanwhile, in a case where a toner in which monodisperse spherical silica particles having a large diameter and single particle size (silica particles having an average primary particle diameter equal to or greater than 80 nm, a particle size distribution which is a normal distribution, an average circularity of 0.9 to 1.0, and a particle size distribution index of 1.05 to 1.25) are externally added to toner particles is used, even when images having a low image density are repeatedly formed in the high temperature and high humidity environment and the same toner continuously receives mechanical loads in a developing unit, the silica particles having a large diameter are rarely embedded in the toner particles and an amount of silica particles supplied to (approaching) the front end of the cleaning nip portion is ensured. A porosity of the externally added dam formed of the monodisperse spherical silica particles having a single particle size is decreased and strength thereof is improved.

However, when an image having a high image density having a large amount of the untransferred toner remaining on the image holding member is formed after repeatedly forming images having a low image density in a high temperature and high humidity environment, and a large amount of the untransferred toner approaches the cleaning nip portion, a large amount of the untransferred toner enters the externally added dam, strength of the dam is not sufficient due to pores present in the externally added dam. Accordingly, the externally added dam may be broken and the passing of the toner from the cleaning nip portion may occur.

With respect to this, when the first silica particles and the second silica particles having an average circularity of 0.9 to 1.0, a particle size distribution index of 1.05 to 1.25, and a compression aggregation degree of 60% to 95% and satisfying relationships of Expressions (A1) to (A3) are externally added to the toner particles, even when images having a low image density are repeatedly formed in the high temperature and high humidity environment, an amount of the silica particles supplied to the front end of the cleaning nip portion is ensured, the strength of the externally added dam is further improved, and even when an image having a high image density is formed, it is difficult to break the externally added dam. The basic configurations are as follows.

The silica particles having an average circularity of 0.9 to 1.0, a particle size distribution index of 1.05 to 1.25, and a compression aggregation degree of 60% to 95% are spherical and monodisperse silica particles having (monodisperse spherical silica particles) and a high cohesive force (intermolecular force) at the time of aggregation. When the silica particles having the properties are externally added to the toner particles, the silica particles densely contact with each other to decrease a porosity and a tendency of forming an externally added dam having a high cohesive force between the silica particles is further increased.

The first silica particles and the second silica particles satisfying relationships of Expressions (A1) to (A3) are small-sized silica particles and large-sized silica particles having an average primary particle diameter in a range of 80 nm to 200 nm and having different particle diameters having a difference in particle diameter of 10 nm to 120 nm. When small-sized silica particles and large-sized silica particles having a relationship of the particle diameters are externally added to the toner particles, even when mechanical loads are continuously received, it is difficult to embed the silica particles to the toner particles, an amount of the silica particles supplied to the front end of the cleaning nip portion is ensured, and a tendency of forming an externally added dam having a low porosity is further increased, due to the silica particles densely contacting with each other due to a difference in particle diameter.

That is, when the first silica particles and the second silica particles having the above properties and satisfying relationships of Expressions (A1) to (A3) are externally added to the toner particles, even when mechanical loads are continuously received, an externally added dam having a large amount of silica particles, a low porosity, and a high cohesive force is formed, the strength of the dam is increased, and when an image having a high image density is formed, it is difficult to break the externally added dam, even when a large amount of untransferred toner enters the externally added dam, unlike in a case where only monodisperse spherical silica particles having a large diameter and single particle size are externally added to the toner particles.

As described above, it is assumed that the toner according to this exemplary embodiment prevents occurrence of the passing of the toner from the cleaning nip portion occurring when images having a high image density are repeatedly formed, after forming an image having a low image density in the high temperature and high humidity environment. In addition, it is assumed that the generation of streak-shaped image defects appearing due to the passing of the toner is also prevented.

In the toner according to this exemplary embodiment, it is difficult to break the externally added dam. Therefore, the passing of an external additive from the cleaning nip portion and image deletion due to the passing of an external additive are also prevented.

Hereinafter, the toner according to this exemplary embodiment will be described in detail.

The toner according to this exemplary embodiment includes toner particles and an external additive.

Toner Particles

The toner particles include a binder resin. The toner particles may include a colorant, a release agent, and other additives, if necessary.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used alone or in combination of two or more kinds thereof.

As the binder resin, a polyester resin is suitable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone or in combination of two or more kinds thereof. Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

It is preferable that a compositional monomer of the polyester resin includes neopentyl glycol.

The glass transition temperature (Tg) of the polyester resin is preferably 50° C. to 80° C., and more preferably 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K 7121-1987 "Testing Methods for Transition Temperature of Plastics".

The weight average molecular weight (Mw) of the polyester resin is preferably 5,000 to 1,000,000 and more preferably 7,000 to 500,000.

The number average molecular weight (Mn) of the polyester resin is preferably 2,000 to 100,000.

The molecular weight distribution Mw/Mn of the polyester resin is preferably 1.5 to 100 and more preferably 2 to 60.

The weight average molecular weight and the number average molecular weight are measured by gel permeation chromatography (GPC). The molecular weight measurement by GPC is performed by using GPC.HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably 40% by weight to 95% by weight, more preferably 50% by weight to 90% by weight, and even more preferably 60% by weight to 85% by weight with respect to a total amount of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is, for example, preferably 1% by weight to 30% by weight, more preferably 3% by weight to 15% by weight with respect to a total amount of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core part (core particle) and a coating layer (shell layer) coated on the core part.

The toner particles having a core/shell structure is composed of, for example, a core part containing a binder resin, and if necessary, other additives such as a colorant and a release agent and a coating layer containing a binder resin.

The volume average particle diameter (D50v) of the toner particles is preferably 2 μm to 10 μm, and more preferably 4 μm to 8 μm.

Various average particle diameters and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume particle size distribution index (GSDv) is calculated as $(D84v/D16v)^{1/2}$, while a number particle size distribution index (GSDp) is calculated as $(D84p/D16p)^{1/2}$.

The average circularity of the toner particles is preferably 0.950 to 0.990 and more preferably 0.957 to 0.980.

The average circularity of the toner particles is measured by using FPIA-3000 manufactured by Sysmex Corporation. In this apparatus, a system of performing measurement regarding particles dispersed in water or the like by a flow type image analysis method is used, a particle suspension absorbed is introduced to a flat sheath flow cell. By irradiating sample fluid with strobe light, the particles passing through the sample fluid are imaged as a still image by using a charge coupled device (CCD) through an objective lens. The captured particle image is processed to obtain a two-dimensional image to calculate a circularly from a projected area and a perimeter. Regarding the circularity, the image analysis of at least 4,000 or more particles is performed and an average circularly is determined by statistical processing.

$$\text{Circularity}=\text{perimeter of equivalent circle diameter/perimeter}=[2\times(A\pi)^{1/2}]/PM \quad \text{Expression}$$

In the above Expression, A represents a projected area and PM represents a perimeter.

In the measurement, a high resolution mode (HPF mode) is used and a dilution degree is 1.0 times. For the analysis of data, a circularity analysis range is in a range of 0.40 to 1.00 in order to remove measurement noise.

External Additive

An external additive includes the first silica particles and the second silica particles. The external additive may include lubricant particles and other external additives. That is, only the first silica particles and the second silica particles may be externally added to the toner particles or the first silica particles, the second silica particles, lubricant particles, and other external additives may be externally added thereto.

Silica Particles

Both of the first silica particles and the second silica particles may be particles using silica, that is, $SiO_2$ as a main component and may be crystalline or amorphous. In addition, both the first silica particles and the second silica particles may be particles prepared by using water glass or a silicon compound such as alkoxysilane as a raw material or may be particles obtained by pulverizing quartz.

Specifically, examples of both of the first silica particles and the second silica particles include sol-gel silica particles, water colloidal silica particles, alcoholic silica particles, fumed silica particles obtained by a gas phase method, and fused silica particles. Among these, sol-gel silica particles are preferably used as the first silica particles and the second silica particles, from a viewpoint of satisfying the following properties.

Both of the first silica particles and the second silica particles are silica particles having an average circularity of 0.9 to 1.0, a particle size distribution index of 1.05 to 1.25, and a compression aggregation degree of 60% to 95%.

When the average circularity of the first silica particles and the second silica particles is 0.9 to 1.0, an externally added dam having a low porosity and a high strength is formed and the passing of the toner from the cleaning nip portion is prevented.

The average circularity of the first silica particles and the second silica particles is preferably 0.92 to 0.98, from viewpoints of improving the strength of the externally added dam and preventing occurrence of the passing of the toner from the cleaning nip portion.

Here, the average circularity of the silica particles is measured by using the following method.

The primary particles after dispersing silica particles in a main body of resin particles having a volume average particle diameter of 100 μm (for example, polyester resin, weight average molecular weight Mw=500,000) are observed by using a SEM device and the circularity of the silica particles is obtained as a value of "100/SF2" calculated by the following Expression from the planar image analysis of the obtained primary particles.

$$\text{Circularity}(100/SF2)=4\pi\times(A/I^2) \qquad \text{Expression}$$

In Expression, I represents a perimeter of primary particles on an image and A represents a projected area of primary particles.

The average circularity of the silica particles is obtained as a circularity of cumulative frequency of circularity of the 100 primary particles obtained by planar image analysis becomes 50%.

When the particle size distribution index of the first silica particles and the second silica particles is 1.05 to 1.25, an externally added dam having a low porosity and a high strength is formed and the passing of the toner from the cleaning nip portion is prevented.

The particle size distribution index of the first silica particles and the second silica particles is preferably 1.05 to 1.2 and more preferably 1.05 to 1.15, from viewpoints of improving the strength of the externally added dam and preventing occurrence of the passing of the toner from the cleaning nip portion.

Here, the particle size distribution index of the silica particles is measured by using the following method.

The primary particles of the silica particles are observed by using a scanning electron microscope (SEM) device (S-4100 manufactured by Hitachi, Ltd.) to capture an image, this image is incorporated in an image analysis device (LUZEX III manufactured by NIRECO), an area for each particle is measured by the image analysis of the primary particles, and an equivalent circle diameter is calculated from this area value. The calculation of this equivalent circle diameter is performed regarding 100 silica particles. A diameter (D16) when cumulative frequency of the obtained based on volume of the obtained equivalent circle diameter becomes 16% and a diameter (D84) when cumulative frequency of the obtained based on volume of the obtained equivalent circle diameter becomes 84% are determined. The square root obtained by dividing the determined diameter (D84) when the cumulative frequency described above is 84% by the diameter (D16) when the cumulative frequency is 16% is set as a particle size distribution index ($=(D84/D16)^{1/2}$). A magnification of an electron microscope is adjusted so that approximately 10 to 50 specified silica particles are shown in 1 viewing field and an equivalent circle diameter of the primary particles is determined by combining observation of plural viewing fields with each other.

When the compression aggregation degree of the first silica particles and the second silica particles is equal to or greater than 60%, an externally added dam having a high cohesive force between silica particles and a high strength is formed and the passing of the toner from the cleaning nip portion is prevented. When the compression aggregation degree of the first silica particles and the second silica particles is equal to or smaller than 95%, an excessive increase in strength of an externally added dam is prevented and the passing of the toner from the cleaning nip portion caused by blade abrasion or chipping of a blade is prevented.

The compression aggregation degree of the first silica particles and the second silica particles is preferably 65% to 95% and more preferably 70% to 95%, from viewpoints of improving the strength of the externally added dam and preventing occurrence of the passing of the toner from the cleaning nip portion.

The compression aggregation degree of the first silica particles and the second silica particles may be adjusted by using the average primary particle diameter, the particle size distribution index, and the average circularity of each of the silica particles and the type and the used amount of a surface treatment agent.

Here, the compression aggregation degree of the silica particles is measured by using the following method.

A disc-shaped die having a diameter of 6 cm is filled with 6.0 g of silica particles. The die is compressed at pressure of 5.0 t/cm$^2$ for 60 seconds by using a compression molding machine and a disc-shaped compressed molded article of the silica particles (hereinafter, referred to as an "molded article before dropping") is obtained. Then, the weight of the molded article before dropping is measured.

The molded article before dropping is disposed on a sieving screen having an aperture of 600 μm and the molded article before dropping is dropped under the conditions of an amplitude of 1 mm and a vibrating time of 1 minute by using a vibration sieving machine (product name: VIBRATING MVB-1 manufactured by Tsutsui Scientific Instruments Co., Ltd.). Accordingly, silica particles are dropped from the molded article before dropping through the sieving screen and the molded article of the silica particles remains on the sieving screen. After that, the weight of the remaining molded article of the silica particles (hereinafter, referred to as a "molded article after dropping") is measured.

A compression aggregation degree is calculated from a ratio of the weight of the molded article after dropping to the weight of the molded article before dropping by using the following Expression.

$$\text{compression aggregation degree}=(\text{weight of the molded article after dropping}/\text{weight of the molded article before dropping})\times 100 \qquad \text{Expression}$$

The average primary particle diameter Da (nm) of the first silica particles and the average primary particle diameter Db (nm) of the second silica particles satisfy relationships of the following Expressions (A1) to (A3).

$$80\leq Da\leq 120 \qquad \text{Expression (A1)}$$

$$120\leq Db\leq 200 \qquad \text{Expression (A2)}$$

$$10\leq Db-Da\leq 120 \qquad \text{Expression (A3)}$$

When the average primary particle diameter Da of the first silica particles which are particles having a small diameter is equal to or greater than 80 nm, the embedding of the first silica particles and the second silica particles into the toner particles is prevented and a certain amount of the silica particles supplied to the cleaning nip portion is ensured, even when images having a low image density are repeatedly formed in the high temperature and high humidity environment (even when the same toner continuously receives mechanical loads).

When the average primary particle diameter Db of the second silica particles which are particles having a large diameter is equal to or smaller than 200 nm, an increase in porosity of the externally added dam is prevented and a decrease in strength of the externally added dam is prevented.

When a difference in particle difference between the average primary particle diameter Da (nm) of the first silica particles and the average primary particle diameter Db (nm) of the second silica particles is equal to or greater than 10 nm, an externally added dam having a low porosity and a high strength is formed and the passing of the toner from the cleaning nip portion is prevented.

When a difference in particle difference between the average primary particle diameter Da (nm) of the first silica particles and the average primary particle diameter Db (nm) of the second silica particles is equal to or smaller than 120 nm, an increase in porosity of the externally added dam is prevented and a decrease in strength of the externally added dam is prevented.

The average primary particle diameter Da (nm) of the first silica particles and the average primary particle diameter Db (nm) of the second silica particles preferably satisfy relationships of the following Expression (A1-2) to (A3-2), from viewpoints of improving the strength of the externally added dam and preventing occurrence of the passing of the toner from the cleaning nip portion.

$$80 \leq Da \leq 100 \quad \text{Expression (A1-2)}$$

$$120 \leq Db \leq 160 \quad \text{Expression (A2-2)}$$

$$20 \leq Db - Da \leq 100 \quad \text{Expression (A3-2)}$$

The average primary particle diameter Da (nm) of the first silica particles and the average primary particle diameter Db (nm) of the second silica particles preferably satisfy relationships of the following Expression (A1-3) to (A3-3), from viewpoints of improving the strength of the externally added dam and preventing occurrence of the passing of the toner from the cleaning nip portion.

$$90 \leq Da \leq 100 \quad \text{Expression (A1-3)}$$

$$140 \leq Db \leq 160 \quad \text{Expression (A2-3)}$$

$$40 \leq Db - Da \leq 90 \quad \text{Expression (A3-3)}$$

Here, the average primary particle diameter of the silica particles is measured by using the following method.

The primary particles of the silica particles are observed by using a scanning electron microscope (SEM) device (S-4100 manufactured by Hitachi, Ltd.) to capture an image, this image is incorporated in an image analysis device (LUZEX III manufactured by NIRECO), an area for each particle is measured by the image analysis of the primary particles, and an equivalent circle diameter is calculated from this area value. The calculation of this equivalent circle diameter is performed regarding 100 silica particles. A diameter (D50) when cumulative frequency of the obtained based on volume of the obtained equivalent circle diameter becomes 50% is set as an average primary particle diameter (average equivalent circle diameter D50) of the silica particles. A magnification of an electron microscope is adjusted so that approximately 10 to 50 silica particles are shown in 1 viewing field and an equivalent circle diameter of the primary particles is determined by combining observation of plural viewing fields with each other.

A compression aggregation degree Ab (%) of the second silica particles and a compression aggregation degree Aa+b (%) of mixed silica particles obtained by mixing the same amount of the first silica particles and the second silica particles with each other preferably satisfy the following Expression (B1).

$$Ab < Aa+b \quad \text{Expression (B1)}$$

When the compression aggregation degree Aa+b (%) of mixed silica particles is higher than the compression aggregation degree Ab (%) of the second silica particles, a strength of an externally added dam in which the first silica particles and the second silica particles are mixed with each other increases and the passing of the toner from the cleaning nip portion is easily prevented.

The compression aggregation degree Aa+b of the mixed silica particles obtained by mixing the same amount of the first silica particles and the second silica particles with each other is measured by using mixed silica particles obtained by mixing the same amount (for example, mixed with 3 g) of the first silica particles and the second silica particles with each other so as to obtain an amount for measuring the compression aggregation degree.

The compression aggregation degree Aa+b may be adjusted by using the average primary particle diameter, the particle size distribution index, and the average circularity of each of the silica particles and the type and the used amount of a surface treatment agent.

A specific gravity Sa (g/cm$^3$) of the hardened first silica particles and a specific gravity Sa (g/cm$^3$) of the hardened second silica particles preferably satisfy the following Expression (C1) to (C3).

$$0.6 \leq Sa \leq 0.9 \quad \text{Expression (C1)}$$

$$0.5 \leq Sb \leq 0.8 \quad \text{Expression (C2)}$$

$$Sb < Sa \quad \text{Expression (C3)}$$

By setting the specific gravity of the hardened first silica particles and second silica particles to be in the range described above and the specific gravity of the hardened first silica particles to be greater than the specific gravity of the hardened second silica particles, when the first silica particles and the second silica particles approach the front end of the cleaning nip portion, re-arrangement is easily performed so that the first silica particles which are particles having a small diameter fill gaps between the second silica particles which are particles having a large diameter, a porosity of an externally added dam is further decreased, a strength thereof is increased, and the passing of the toner from the cleaning nip portion is easily prevented.

The specific gravity of the hardened first silica particles and second silica particles may be adjusted by using the average primary particle diameter, the particle size distribution index, and the average circularity of each of the silica particles and the type and the used amount of a surface treatment agent.

Here, the specific gravity of the hardened silica particles is measured by using the following method.

A container having a volume of 100 cm$^3$ is filled by naturally dropping silica particles by using a powder tester (product number: PT-S type manufactured by Hosokawa Micron Corporation). An impact is repeatedly applied to a bottom portion of the container 180 times with a length of stroke of 18 mm at a tapping rate of 50 tapping/min (tapping), degassing is performed and the silica particles in the container are re-arranged to be densely filled. After that, the specific gravity of hardened silica particles (=weight/volume) is determined from the volume ($cm^3$) and the weight (g) of the silica particles in the container.

The surfaces of the first silica particles and the second silica particles may be treated with a hydrophobizing agent. The treatment with a hydrophobizing agent is, for example, performed by dipping organic particles in a hydrophobizing agent. The hydrophobizing agent is not particularly limited and examples thereof include well-known organic silicon compounds including an alkyl group (for example, a methyl group, an ethyl group, a propyl group, or a butyl group), and specific examples thereof include silane coupling agents of silazane compounds (for example, silane compounds such as methyltrimethoxysilane, dimethyldimethoxysilane, trimethylchlorosilane, or trimethylmethoxysilane; hexamethyldisilazane; or tetramethyldisilazane). Examples of the hydrophobizing agent include silicone oil, a titanate coupling agent, and an aluminum coupling agent. These may be used alone or in combination of two or more kinds thereof.

Generally, the amount of the hydrophobizing agent is, for example, 1 part by weight to 200 parts by weight with respect to 100 parts by weight of the silica particles.

Here, the compression aggregation degree of the first silica particles and the second silica particles may be adjusted by using the type and the amount of the hydrophobizing agent.

The total amount (total content) of the first silica particles and the second silica particles externally added is preferably 0.5% by weight to 3.0% by weight, more preferably 1.0% by weight to 3.0% by weight, and even more preferably 1.5% by weight to 2.5% by weight with respect to the toner particles.

When the total amount (total content) of the first silica particles and the second silica particles externally added is equal to or greater than 0.5% by weight, the amount of the silica particles supplied to the front end of the cleaning nip portion is easily ensured.

When the total amount (total content) of the first silica particles and the second silica particles externally added is equal to or smaller than 3.0% by weight, the excessive isolation of the silica particles from the toner particles is prevented and the passing of the silica particles from the cleaning nip portion is prevented.

A ratio of the amount (content) of the first silica particles externally added to the amount (content) of the second silica particles externally added (weight ratio: amount of the first silica particles externally added/amount of the second silica particles externally added) is preferably 25/75 to 75/25, more preferably 35/65 to 70/30, and even more preferably 40/60 to 60/40.

When the ratio of the amount (content) of the first silica particles externally added to the amount (content) of the second silica particles externally added is 25/75 to 75/25, a porosity of the externally added dam is further decreased, a strength thereof is increased, and the passing of the toner from the cleaning nip portion is easily prevented.

Lubricant Particles

As the lubricant particles, at least one kind selected from the group consisting of resin particles and metallic soap particles is used. These particles function as a binding agent of an externally added dam formed of the first silica particles and the second silica particles, further increase the strength of the externally added dam, and allow the passing of the toner from the cleaning nip portion to be easily prevented.

Examples of the resin particles include fluorine resin particles, wax resin particles, and organic resin particles other than fluorine resin particles.

Examples of the fluorine resin particles include particles of polytetrafluoroethylene (PTFE, "tetrafluoroethylene resin"), perfluoroalkoxy fluorine resins, polychlorotrifluoroethylene, polyvinylidenefluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer, a tetrafluoroethylene-hexafluoropropylene-perfluoroalkyl vinyl ether copolymer, and a tetrafluoroethylene-perfluoroalkoxy ethylene copolymer.

Examples of the wax resin particles include polyethylene wax particles, polypropylene particles, montanic acid ester particles, and higher alcohol particles.

Examples of the organic resin particles include polystyrene particles and polymethyl methacrylate particles.

Among these resin particles, polytetrafluoroethylene (PTFE) is preferable, from viewpoints of further increasing the strength of the externally added dam and preventing the passing of the toner from the cleaning nip portion.

As the metallic soap particles, fatty acid metal salt particles are used, for example. The fatty acid metal salt particles are particles of salt formed of fatty acid and metal.

Fatty acid may be any one of saturated fatty acid or unsaturated fatty acid. As the fatty acid, fatty acid having 10 to 25 carbon atoms (preferably 12 to 22 carbon atoms) is used. The carbon number of fatty acid is a value containing the number of carbon atoms of a carboxylic group.

Examples of fatty acid include unsaturated fatty acid such as behenic acid, stearic acid, palmitic acid, myristic acid, or lauric acid; or unsaturated fatty acid such as oleic acid, linoleic acid, or ricinoleic acid. Among these fatty acid, stearic acid and lauric acid are preferable and stearic acid is more preferable.

As the metal, divalent metal may be used. Examples of metal include magnesium, calcium, aluminum, barium, and zinc. Among these, zinc is preferable as the metal.

Examples of fatty acid metal salt particles include particles of metal salt of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, or sodium stearate; metal salt of palmitic acid such as zinc palmitate, cobalt palmitate, copper palmitate, magnesium palmitate, aluminum palmitate, or calcium palmitate; metal salt of lauric acid such as zinc laurate, manganese laurate, calcium laurate, iron laurate, magnesium laurate, or aluminum laurate; metal salt of oleic acid such as zinc oleate, manganese oleate, iron oleate, aluminum oleate, copper oleate, magnesium oleate, or calcium oleate; metal salt of linoleic acid such as zinc linoleate, cobalt linoleate, or calcium linoleate; and metal salt of ricinoleic acid such as zinc ricinoleate or aluminum ricinoleate.

Among these, as the fatty acid metal salt particles, particles of metal salt of stearic acid or metal salt of lauric acid are preferable, particles of zinc stearate or zinc laurate are more preferable, and zinc stearate particles are even more preferable.

An average primary particle diameter of the lubricant particles is preferably 0.1 μm to 10 μm and more preferably 0.2 μm to 8 μm, from viewpoints of improving the strength of the externally added dam and preventing occurrence of the passing of the toner from the cleaning nip portion.

Regarding the average primary particle diameter of the lubricant particles, the lubricant particles are observed by using a scanning electron microscope (SEM) by using the same method in a case of the average primary particle diameter of the silica particles, particles corresponding to the image area of the lubricant particles are formed into a circular shape for approximation, particle diameters (average value of long diameter and short diameter) of 100 portions are measured, and an average value thereof is calculated as the average primary particle diameter of the lubricant particles.

The amount (content) of the lubricant particles externally added is preferably 0.01% by weight to 0.5% by weight and more preferably 0.05% by weight to 0.3% by weight with respect to the toner particles, from viewpoints of improving the strength of the externally added dam and preventing occurrence of the passing of the toner from the cleaning nip portion.

Other External Additives

As the external additives, inorganic particles other than the first silica particles and the second silica particles are used.

Examples of the external additives include particles of silica, alumina, titanium oxide, barium titanate, magnesium titanate, calcium titanate, strontium titanate, zinc oxide, chromium oxide, cerium oxide, magnesium oxide, zirconium oxide, silicon carbide, and silicon nitride.

The surfaces of the other inorganic particles may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, 1 part by weight to 10 parts by weight with respect to 100 parts by weight of the other inorganic particles.

The amount (content) of the other external additives externally added is, for example, preferably 0.05% by weight to 5.0% by weight and more preferably 0.5% by weight to 3.0% by weight with respect to the toner particles.

Preparing Method of Toner

Next, a preparing method of the toner according to this exemplary embodiment will be described.

The toner according to the exemplary embodiment is obtained by externally adding an external additive to toner particles, if necessary, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably 0.01 parts by weight to 5.0 parts by weight, and more preferably 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, and freeze drying, flush drying, fluidized drying, vibration-type fluidized drying, or the like may be performed from a viewpoint of productivity.

Then, the toner according to the exemplary embodiment may be prepared by adding an external additive to the obtained dry toner particles and mixing the materials. The mixing may be performed by using a V blender, a HENSCHEL MIXER, a LÖdige mixer, and the like. Further, if necessary, coarse toner particles may be removed by using a vibration classifier, a wind classifier, and the like.

Electrostatic Charge Image Developer

An electrostatic charge image developer according to the exemplary embodiment contains at least the toner according to this exemplary embodiment.

The electrostatic charge image developer according to the exemplary embodiment may be a two-component developer containing only the toner according to this exemplary embodiment or may be a two-component developer obtained by mixing the toner and a carrier.

Carrier

The carrier is not particularly limited and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member to a surface of a recording medium, a cleaning unit that includes a cleaning blade that cleans the surface of the image holding member, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the processes of: charging a surface of an image holding member; forming an electrostatic charge image on the charged surface of the image holding member; developing the electrostatic charge image formed on the surface of the image holding member with the electrostatic charge image developer according to this exemplary embodiment as a toner image; transferring the toner image formed on the surface of the image holding member to a surface of a recording medium; cleaning the surface of the image holding member with a cleaning blade; and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; or an apparatus that is provided with an erasing unit that irradiates, after transfer of a toner image, a surface of an image holding member with erase light before charging for erasing.

In a case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is suitably used.

Hereinafter, an example of the image forming apparatus according to this exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting with the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that includes a cleaning blade 6Y-1 that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, so that an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting with the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
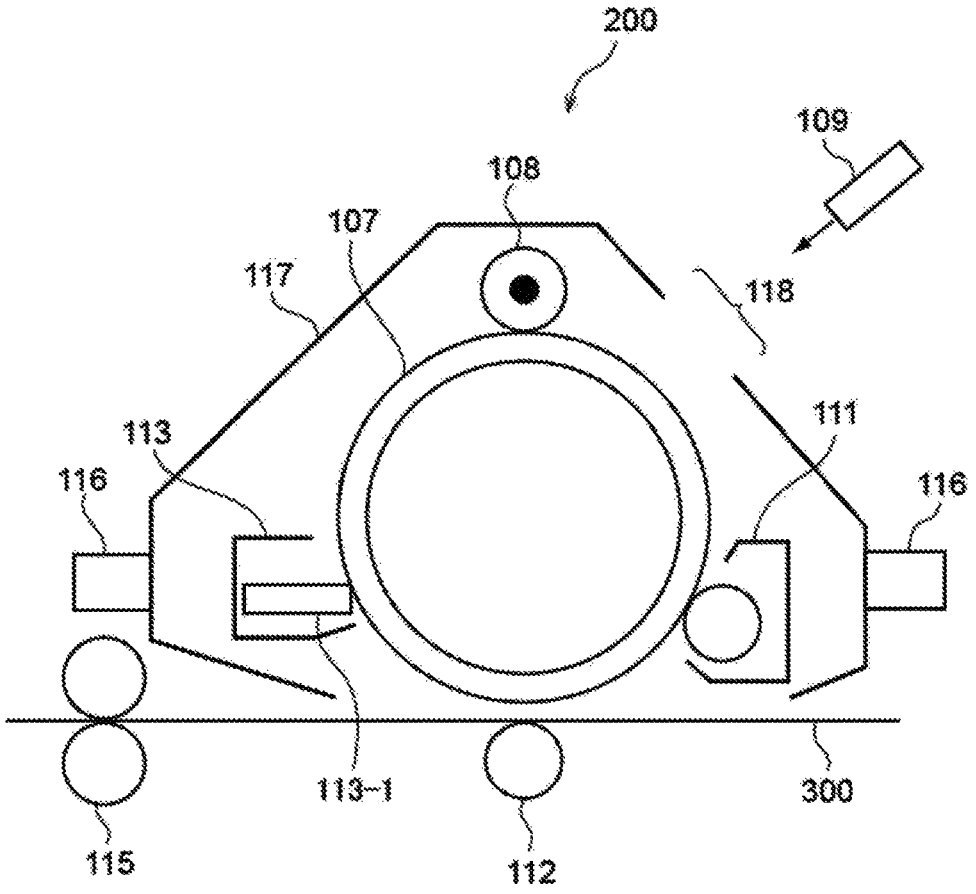
FIG. 2 is a schematic configuration diagram showing a process cartridge according to this exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) that includes a cleaning blade 113-1, which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus. The toner cartridge may have a container that contains the electrostatic charge image developing toner according to this exemplary embodiment.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

The exemplary embodiments will be described more specifically with reference to examples and comparative examples, but the exemplary embodiments are not limited to the following examples. Unless specifically noted, "parts" and "%" represent "parts by weight" and "% by weight".

Preparation of Toner Particles

Toner Particles (1)

Preparation of Polyester Resin Dispersion

Ethylene glycol (manufactured by Wako Pure Chemical Industries, Ltd.): 37 parts

Neopentyl glycol (manufactured by Wako Pure Chemical Industries, Ltd.): 65 parts 1,9 nonanediol (manufactured by Wako Pure Chemical Industries, Ltd.): 32 parts Terephthalic acid (manufactured by Wako Pure Chemical Industries, Ltd.): 96 parts The above monomers are put into a flask, heated to a temperature of 200° C. for 1 hours, and after confirming that a reaction system is stirred, and 1.2 parts of dibutyl tin oxide is put thereto. The temperature is increased from the temperature described above to 240° C. over 6 hours while distilling away generated water, and a dehydration condensation reaction is further continued at 240° C. for 4 hours, to thereby obtain a polyester resin A having an acid value of 9.4 mgKOH/g, an weight average molecule weight of 13,000, and a glass transition temperature of 62° C.

Then, the polyester resin A as in a melted state is transferred to CAVITRON CD1010 (manufactured by Eurotec Ltd.) at a rate of 100 parts per minute. A diluted ammonia water having concentration of 0.37% obtained by diluting reagent ammonia water with ion exchange water is put into an aqueous medium tank which is separately prepared, and is transferred to CAVITRON described above at the same time as the polyester resin melted material at a rate of 0.1 liters per min, while heating a heat exchanger at 120° C. CAVITRON is operated under the conditions of a rotation rate of a rotor of 60 Hz and pressure of 5 kg/cm$^2$, and thus, an amorphous polyester resin dispersion in which resin particles having a volume average particle diameter of 160 nm, a solid content of 30%, a glass transition temperature of 62° C., and a weight average molecular weight Mw of 13,000 are dispersed is obtained.

Preparation of Colorant Particle Dispersion

Cyan pigment (PIGMENT BLUE 15:3 manufactured by Dainichiseika Color & Chemicals Mfg. Co., Ltd.): 10 parts Anionic surfactant (NEOGEN SC manufactured by DKS Co., Ltd.): 2 parts Ion exchange water: 80 parts The above components are mixed with each other, and dispersed by using a high pressure impact type dispersing machine ULTIMIZER (HJP30006 manufactured by SUGINO MACHINE LIMITED) for 1 hour, and thus, a colorant particle dispersion having a volume average particle diameter of 180 nm and a solid content of 20% is obtained.

Preparation of Release Agent Particle Dispersion

Paraffin Wax (HNP 9 manufactured by Nippon Seiro Co., Ltd.): 50 parts

Anionic surfactant (NEOGEN SC manufactured by DKS Co., Ltd.): 2 parts

Ion exchange water: 200 parts

The above components is heated to 120° C., and sufficiently mixed with each other and dispersed using ULTRA TURRAX T50 manufactured by IKA Works, Inc. The mixture is dispersed using a pressure discharge type homogenizer and thus, a release agent particle dispersion having a volume average particle diameter of 200 nm and solid content of 20% is obtained.

Preparation of Toner Particles (1)

Polyester resin particle dispersion: 210 parts

Colorant particle dispersion: 25 parts

Release agent particle dispersion: 30 parts

Polyaluminum chloride: 0.4 parts

Ion exchange water: 100 parts

The above components are put in a stainless steel flask, sufficiently mixed with each other and dispersed by using ULTRA TURRAX manufactured by IKA Works, Inc. Then, the mixture is heated to 48° C. while stirring the components in the flask in a heating oil bath. After maintaining the mixture at 48° C. for 25 minutes, 70 parts of the same polyester resin dispersion as described above is gently added thereto.

Then, after adjusting the pH in the system to 8.0 using a sodium hydroxide solution having concentration of 0.5 mol/L, the stainless steel flask is sealed, a seal of a stirring shaft is magnetically sealed, and the temperature is increased to 90° C. while continuing stirring and maintained for 3 hours. After the reaction ends, the mixture is cooled at a rate of temperature decrease of 2° C./min, filtered, and sufficiently washed with ion exchange water, and a solid-liquid separation is performed by Nutsche-type suction filtration. In addition, the solid content is dispersed again using 3 L of ion exchange water at 30° C., stirred and washed at 300 rpm for 15 minutes. This washing operation is further repeated six times. When the pH of the filtrate is 7.54 and electrical conductivity is 6.5 μS/cm, the solid-liquid separation is performed by Nutsche-type suction filtration using No. 5A filter paper. Next, vacuum drying is continued for 12 hours and thus, toner particles (1) are obtained.

A volume average particle diameter (D50v) of the toner particles (1) is 6.1 μm and an average circularity thereof is 0.965.

Preparation of External Additives

Preparation of Silica Particles

Silica Particles (S1)

Preparation of Silica Particle Dispersion (S1)

300 parts of methanol and 70 parts of 10% ammonia water are added into a 1.5 L glass reaction vessel including a stirrer, a dripping nozzle, and a thermometer and mixed with each other to obtain an alkali catalyst solution.

After adjusting the temperature of this alkali catalyst solution to 30° C., 153 parts of tetramethoxysilane (TMOS) and 42 parts of 8.0% ammonia water are added dropwise to the alkali catalyst solution at the same time while being stirred, to obtain a hydrophilic silica particle dispersion (concentration of solid content of 12.0%). Here, the drop time is 28 minutes.

After that, the obtained silica particle dispersion is concentrated by using a rotary filter R-FINE (manufactured by Kotobuki Industries Co., Ltd.) to have a concentration of solid contents of 40%. The concentrated material is set as a silica particle dispersion (S1).

Preparation of Silica Particles (S1)

60 parts of hexamethyldisilazane (HMDS) is added to 250 parts of the silica particle dispersion (S1) as a hydrophobizing agent to allow a reaction at 130° C. for 2 hours, the resultant material is cooled and dried by spray drying, and thus, hydrophobic silica particles (S1) in which surfaces of silica particles are treated with the hydrophobizing agent are obtained.

Silica Particles (S2) to (S18)

Silica particles (S2) to (S18) are prepared in the same manner as in the preparation of the silica particles (S1), except for changing the alkali catalyst solution (amount of methanol and amount of 10% ammonia water), the conditions for forming the silica particles (total amount of tetramethoxysilane (shown as TMOS) and 8% ammonia water added dropwise to alkali catalyst solution and drop time), and the type and the amount of the hydrophobizing agent according to Table 1.

Silica Particles (S19)

100 parts of silica particles (AEROSIL 200 (manufactured by Nippon Aerosil co. Ltd.)) is put into a mixer and stirred at 200 rpm while performing heating to 200° C. under the nitrogen atmosphere, and HMDS is added dropwise to 100 parts of powder of the silica particles at a drop rate of 10 parts per 1 hour to obtain 25 parts in total. After the total amount thereof is added dropwise, a reaction is allowed for 2 hours. Then, the resultant material is cooled and treated with a hydrophobizing agent.

Silica particles (S19) are prepared through the above operations.

Example 1

0.85 parts of the silica particles (S1), 0.85 parts of the silica particles (S6), and 0.1 parts of zinc stearate particles (product name: "SZ-2000" (manufactured by Sakai Chemical Industry Co., Ltd.), average primary particle diameter=3 μm) are added to 100 parts of the toner particles (1) as the external additives (first silica particles, second silica particles, and other external additives) and mixed with each other with a HENSCHEL MIXER at a stirring circumferential speed of 30 m/sec for 15 minutes to thereby obtain a toner.

The obtained toner and a carrier are put into a V blender at a ratio of toner:carrier=8:92 (weight ratio) and stirred for 20 minutes, to thereby obtain a developer.

As the carrier, a carrier prepared as follows is used.

Ferrite particles (volume average particle diameter of 36 μm): 100 parts

Toluene: 14 parts

A styrene-methyl methacrylate copolymer: 2 parts (component ratio: 90/10, Mw=80,000)

Carbon black (R330 manufactured by Cabot Corporation): 0.2 parts

First, the above components excluding the ferrite particles are stirred by a stirrer for 10 minutes to prepare a dispersed coating solution, this coating solution and the ferrite particles are put into a vacuum degassing type kneader, stirred at 60° C. for 30 minutes, degassed under the reduced pressure while heating, and dried to thereby obtain a carrier.

Examples 2 to 14 and Comparative Examples 1 to 9

Toners and developers are prepared in the same manner as in Example 1, except for changing the type of the toner particles and the type and the number of parts of the external additives (first silica particles, second silica particles, and other external additives) according to Tables 2 to 3.

Measurement of Properties

Regarding the external additives (silica particles) used in the developer and the toner of each example, the average circularity, the particle size distribution index, the compression aggregation degree, the compression aggregation degree of mixed silica particles obtained by mixing two kinds of silica particles, and specific gravity of hardened silica particles are measured based on the method described above. The various properties are shown in Tables 1 to 3.

Evaluation

The developer of each example is included in a developing device of a modified apparatus (modified apparatus excluding a concentration automatic control sensor for environmental variation) of an image forming apparatus "Apeos PortIVC5575 (Fuji Xerox Co., Ltd.)". After continuously printing images having an image density of 1% on 20,000 A4-sized sheets in the high temperature and high humidity environment (in environment at 28° C. and 85% RH) by using the modified apparatus of the image forming apparatus, images having an image density of 40% are continuously printed on 100 A4-sized sheets. Then, the following evaluation is performed. The results of the evaluation are shown in Table 4.

Amount of Externally Added Dam on Front End of Cleaning Nip Portion

The amount of the externally added dam (amount of external additive) on the front end of the cleaning nip portion (portion on a downstream side of the contact portion between the blade and the image holding member in an image holding member rotating direction) is evaluated. The evaluation of the amount of the externally added dam (amount of external additive) is performed with the observation performed by using a laser microscope (manufactured by Keyence Corporation).

Evaluation criteria are as follows. The acceptable levels are levels up to G2.

Evaluation Criteria

G1: A remarkable amount of the external additives is observed on the front end of the cleaning nip portion.

G2: A sufficient amount of the external additives is observed on the front end of the cleaning nip portion.

G3: Only a slight amount of the external additives is observed on the front end of the cleaning nip portion.

G4: Substantially no external additives are observed on the front end of the cleaning nip portion.

Passing of External Additives from Cleaning Nip Portion

The image which is finally printed is visually observed and an occurrence state of "deletion of an image" caused by the passing of the external additives from the cleaning nip portion is evaluated.

Evaluation criteria are as follows. The acceptable levels are levels up to G3.

Evaluation Criteria

G1: Substantially no parts of deletion are observed.

G2: Parts of deletion are slightly observed.

G3: Parts of deletion are partially observed.

G4: Parts of deletion are obviously observed.

G5: The area of parts of deletion is large.

Passing of Toner from Cleaning Nip Portion

The image which is finally printed is visually observed and an occurrence state of "color streaks" caused by the passing of the toner from the cleaning nip portion is evaluated.

Evaluation criteria are as follows. The acceptable levels are levels up to G3.

Evaluation Criteria

G1+: A remarkably excellent image having no color streaks caused by the passing of the toner is obtained.

G1: A very excellent image substantially having no color streaks caused by the passing of the toner is obtained.

G2: An excellent image having slight color streaks caused by the passing of the toner is obtained.

G3: An acceptable image having partially observed color streaks caused by the passing of the toner is obtained.

G4: An image having obviously observed color streaks caused by the passing of the toner is obtained.

G5: An image having a remarkably large area of color streaks caused by the passing of the toner is obtained.

Here, the details of abbreviations shown in each table are as follows.

"Da", "Ca", "GSDa", "Aa", and "Sa": respectively, "average primary particle diameter", "average circularity", "particle size distribution index", "compression aggregation degree", and "specific gravity of hardened silica particles" of first silica particles "Db", "Cb", "GSDb", "Ab", and "Sb": respectively, "average primary particle diameter", "average circularity", "particle size distribution index", "compression aggregation degree", and "specific gravity of hardened silica particles" of second silica particles "Aa+b": compression aggregation degree of mixed silica particles obtained by mixing the same amounts of the first silica particles and the second silica particles TMOS: tetramethoxysilane HMDS: hexamethyldisilazane ZnSt: zinc stearate particles (product name: "SZ-2000" (manufactured by Sakai Chemical Industry Co., Ltd.), average primary particle diameter=3 μm)

PTFE: polytetrafluoroethylene (product name: "LUBRON L2 (manufactured by Dai kin Industries, Ltd.)", average primary particle diameter=0.3 μm)

TABLE 1

| | Preparation of silica particle dispersion | | | | | | | Properties | | | | |
|---|---|---|---|---|---|---|---|---|---|---|---|---|
| | Alkali catalyst solution | | Conditions for generating silica particles | | | Treatment with hydrophobizing agent | | | | | | |
| Silica particles | Methanol (parts) | 10% ammonia water (parts) | Total amount of TMOS added dropwise (parts) | Total amount of 8% ammonia water added dropwise (parts) | Drop time (min) | Kind of hydrophobizing agent | Amount (parts) | Average primary particle diameter (nm) | Average circularity | Particle size distribution index | Compression aggregation degree (%) | specific gravity of hardened silica particles (g/cm$^3$) |
| (S1) | 300 | 70 | 153 | 42 | 28 | HMDS | 60 | 102 | 0.97 | 1.12 | 82 | 0.8 |
| (S2) | 300 | 70 | 165 | 45 | 30 | HMDS | 65 | 110 | 0.96 | 1.11 | 80 | 0.75 |
| (S3) | 300 | 70 | 120 | 33 | 22 | HMDS | 60 | 80 | 0.95 | 1.15 | 90 | 0.84 |
| (S4) | 300 | 70 | 108 | 29 | 20 | HMDS | 70 | 72 | 0.95 | 1.14 | 92 | 0.83 |
| (S5) | 300 | 70 | 188 | 51 | 34 | HMDS | 70 | 125 | 0.96 | 1.1 | 76 | 0.72 |
| (S6) | 300 | 70 | 236 | 64 | 43 | HMDS | 90 | 157 | 0.96 | 1.1 | 72 | 0.7 |
| (S7) | 300 | 70 | 180 | 49 | 33 | HMDS | 72 | 120 | 0.94 | 1.18 | 74 | 0.71 |
| (S8) | 300 | 70 | 297 | 81 | 54 | HMDS | 60 | 198 | 0.95 | 1.1 | 70 | 0.62 |
| (S9) | 300 | 70 | 173 | 47 | 31 | HMDS | 35 | 115 | 0.96 | 1.14 | 78 | 0.76 |
| (S10) | 300 | 70 | 315 | 86 | 57 | HMDS | 60 | 210 | 0.95 | 1.11 | 71 | 0.65 |
| (S11) | 280 | 52 | 236 | 64 | 43 | HMDS | 90 | 158 | 0.87 | 1.16 | 72 | 0.65 |
| (S12) | 260 | 49 | 230 | 60 | 20 | HMDS | 60 | 155 | 0.91 | 1.28 | 67 | 0.62 |
| (S13) | 300 | 70 | 236 | 64 | 43 | HMDS | 20 | 156 | 0.94 | 1.17 | 55 | 0.67 |
| (S14) | 300 | 70 | 120 | 33 | 20 | HMDS | 90 | 80 | 0.95 | 1.15 | 97 | 0.86 |
| (S15) | 300 | 70 | 153 | 42 | 28 | HMDS | 30 | 101 | 0.95 | 1.17 | 70 | 0.72 |
| (S16) | 285 | 55 | 165 | 45 | 30 | HMDS | 65 | 110 | 0.9 | 1.25 | 72 | 0.58 |
| (S17) | 285 | 55 | 297 | 81 | 54 | HMDS | 60 | 198 | 0.9 | 1.23 | 63 | 0.52 |
| (S18) | 300 | 70 | 180 | 49 | 33 | HMDS | 100 | 120 | 0.97 | 1.1 | 78 | 0.82 |
| (S19) | Silica particles (AEROSIL 200 (manufactured by Nippon Aerosil co. Ltd.)) | | | | | HMDS | 25 | 70 | 0.7 | 1.52 | 80 | 0.35 |

TABLE 2

| | Toner | External additives | | | | | | | | |
|---|---|---|---|---|---|---|---|---|---|---|
| | | First silica particles | | | | | | | Second silica particles | |
| | particles Type | Type | Number of parts | Da (nm) | Ca | GSD a | Aa (%) | Sa (g/cm$^3$) | Type | Number of parts |
| Example 1 | 1 | S1 | 0.85 | 102 | 0.97 | 1.12 | 82 | 0.8 | S6 | 0.85 |
| Example 2 | 1 | S2 | 0.85 | 110 | 0.96 | 1.11 | 80 | 0.75 | S7 | 0.85 |
| Example 3 | 1 | S3 | 0.85 | 80 | 0.95 | 1.15 | 90 | 0.84 | S8 | 0.85 |
| Example 4 | 1 | S3 | 0.85 | 80 | 0.95 | 1.15 | 90 | 0.84 | S7 | 0.85 |
| Example 5 | 1 | S2 | 0.85 | 110 | 0.96 | 1.11 | 80 | 0.75 | S8 | 0.85 |
| Example 6 | 1 | S15 | 0.85 | 101 | 0.95 | 1.17 | 70 | 0.72 | S6 | 0.85 |
| Example 7 | 1 | S16 | 0.85 | 110 | 0.9 | 1.25 | 72 | 0.58 | S17 | 0.85 |
| Example 8 | 1 | S3 | 0.85 | 80 | 0.95 | 1.15 | 90 | 0.84 | S18 | 0.85 |
| Example 9 | 1 | S16 | 0.85 | 110 | 0.9 | 1.25 | 72 | 0.58 | S8 | 0.85 |
| Example 10 | 1 | S1 | 0.85 | 102 | 0.97 | 1.12 | 82 | 0.8 | S6 | 0.85 |
| Example 11 | 1 | S1 | 0.43 | 102 | 0.97 | 1.12 | 82 | 0.8 | S6 | 1.27 |
| Example 12 | 1 | S1 | 1.27 | 102 | 0.97 | 1.12 | 82 | 0.8 | S6 | 0.43 |
| Example 13 | 1 | S1 | 0.85 | 102 | 0.97 | 1.12 | 82 | 0.8 | S6 | 0.85 |
| Example 14 | 1 | S1 | 0.85 | 102 | 0.97 | 1.12 | 82 | 0.8 | S6 | 0.85 |

| | External additives | | | | | | | | | |
|---|---|---|---|---|---|---|---|---|---|---|
| | Second silica particles | | | | | Relationships of first and second silica particles | | | Other external additives | |
| | Db (nm) | Cb | GSD b | Ab (%) | Sb (g/cm$^3$) | Db-Da (nm) | Aa + b (%) | Sa-Sb (g/cm$^3$) | Type | Number of parts |
| Example 1 | 157 | 0.96 | 1.1 | 72 | 0.7 | 55 | 80 | 0.1 | ZnSt | 0.1 |
| Example 2 | 120 | 0.94 | 1.18 | 74 | 0.71 | 10 | 76 | 0.04 | ZnSt | 0.1 |
| Example 3 | 198 | 0.95 | 1.1 | 70 | 0.62 | 118 | 80 | 0.22 | ZnSt | 0.1 |
| Example 4 | 120 | 0.94 | 1.18 | 74 | 0.71 | 40 | 82 | 0.13 | ZnSt | 0.1 |
| Example 5 | 198 | 0.95 | 1.1 | 70 | 0.62 | 88 | 75 | 0.13 | ZnSt | 0.1 |
| Example 6 | 157 | 0.96 | 1.1 | 72 | 0.7 | 56 | 72 | 0.02 | ZnSt | 0.1 |
| Example 7 | 198 | 0.9 | 1.23 | 63 | 0.52 | 88 | 68 | 0.06 | ZnSt | 0.1 |

TABLE 2-continued

| | | | | | | | | | | |
|---|---|---|---|---|---|---|---|---|---|---|
| Example 8 | 120 | 0.97 | 1.1 | 78 | 0.82 | 40 | 85 | 0.02 | ZnSt | 0.1 |
| Example 9 | 198 | 0.95 | 1.1 | 70 | 0.62 | 88 | 71 | −0.04 | ZnSt | 0.1 |
| Example 10 | 157 | 0.96 | 1.1 | 72 | 0.7 | 55 | 80 | 0.1 | — | — |
| Example 11 | 157 | 0.96 | 1.1 | 72 | 0.7 | 55 | 80 | 0.1 | ZnSt | 0.1 |
| Example 12 | 157 | 0.96 | 1.1 | 72 | 0.7 | 55 | 80 | 0.1 | ZnSt | 0.1 |
| Example 13 | 157 | 0.96 | 1.1 | 72 | 0.7 | 55 | 80 | 0.1 | PTFE | 0.1 |
| Example 14 | 157 | 0.96 | 1.1 | 72 | 0.7 | 55 | 80 | 0.1 | ZnSt/ PTFE | 0.1/ 0.1 |

TABLE 3

| | | External additives | | | | | | | | |
|---|---|---|---|---|---|---|---|---|---|---|
| | Toner | First silica particles | | | | | | | Second silica particles | |
| | particles Type | Type | Number of parts | Da (nm) | Ca | GSD a | Aa (%) | Sa (g/cm$^3$) | Type | Number of parts |
| Comparative Example 1 | 1 | S4 | 0.85 | 72 | 0.95 | 1.14 | 92 | 0.83 | S6 | 0.85 |
| Comparative Example 2 | 1 | S5 | 0.85 | 125 | 0.96 | 1.11 | 76 | 0.72 | S10 | 0.85 |
| Comparative Example 3 | 1 | S9 | 0.85 | 115 | 0.96 | 1.14 | 78 | 0.76 | S7 | 0.85 |
| Comparative Example 4 | 1 | S3 | 0.85 | 80 | 0.95 | 1.15 | 90 | 0.84 | S10 | 0.85 |
| Comparative Example 5 | 1 | S1 | 0.85 | 102 | 0.97 | 1.12 | 82 | 0.8 | S11 | 0.85 |
| Comparative Example 6 | 1 | S1 | 0.85 | 102 | 0.97 | 1.12 | 82 | 0.8 | S12 | 0.85 |
| Comparative Example 7 | 1 | S1 | 0.85 | 102 | 0.97 | 1.12 | 82 | 0.8 | S13 | 0.85 |
| Comparative Example 8 | 1 | S14 | 0.85 | 80 | 0.95 | 1.15 | 97 | 0.86 | S6 | 0.85 |
| Comparative Example 9 | 1 | S19 | 0.85 | 70 | 0.7 | 1.52 | 80 | 0.35 | S6 | 0.85 |

| | External additives | | | | | | | | | |
|---|---|---|---|---|---|---|---|---|---|---|
| | Second silica particles | | | | | Relationships of first and second silica particles | | | Other external additives | |
| | Db (nm) | Cb | GSD b | Ab (%) | Sb (g/cm$^3$) | Db-Da (nm) | Aa + b (%) | Sa-Sb (g/cm$^3$) | Type | Number of parts |
| Comparative Example 1 | 157 | 0.96 | 1.1 | 72 | 0.7 | 85 | 81 | 0.13 | ZnSt | 0.1 |
| Comparative Example 2 | 210 | 0.95 | 1.11 | 71 | 0.65 | 85 | 72 | 0.07 | ZnSt | 0.1 |
| Comparative Example 3 | 120 | 0.94 | 1.18 | 74 | 0.71 | 5 | 75 | 0.05 | ZnSt | 0.1 |
| Comparative Example 4 | 210 | 0.95 | 1.11 | 71 | 0.65 | 130 | 80 | 0.19 | ZnSt | 0.1 |
| Comparative Example 5 | 158 | 0.87 | 1.16 | 72 | 0.65 | 56 | 77 | 0.15 | ZnSt | 0.1 |
| Comparative Example 6 | 155 | 0.91 | 1.28 | 67 | 0.62 | 53 | 70 | 0.18 | ZnSt | 0.1 |
| Comparative Example 7 | 156 | 0.94 | 1.17 | 55 | 0.67 | 53 | 70 | 0.13 | ZnSt | 0.1 |
| Comparative Example 8 | 157 | 0.96 | 1.1 | 72 | 0.7 | 77 | 87 | 0.16 | ZnSt | 0.1 |
| Comparative Example 9 | 157 | 0.96 | 1.1 | 72 | 0.7 | 87 | 76 | −0.35 | ZnSt | 0.1 |

TABLE 4

| | Amount of externally added dam on front end of cleaning nip portion | Passing of external additive from cleaning nip portion | Passing of toner from cleaning nip portion |
|---|---|---|---|
| Example 1 | G1 | G1 | G1 |
| Example 2 | G1 | G1 | G3 |
| Example 3 | G2 | G2 | G3 |
| Example 4 | G2 | G1 | G2 |
| Example 5 | G1 | G2 | G2 |
| Example 6 | G1 | G1 | G2 |
| Example 7 | G1 | G2 | G3 |
| Example 8 | G2 | G1 | G3 |
| Example 9 | G1 | G2 | G3 |
| Example 10 | G1 | G1 | G2 |
| Example 11 | G1 | G2 | G1 |
| Example 12 | G1 | G1 | G2 |
| Example 13 | G1 | G1 | G1 |
| Example 14 | G1 | G1 | G1+ |
| Comparative Example 1 | G2 | G1 | G4 |
| Comparative Example 2 | G1 | G4 | G4 |
| Comparative Example 3 | G1 | G1 | G4 |
| Comparative Example 4 | G2 | G5 | G4 |
| Comparative Example 5 | G3 | G3 | G5 |
| Comparative Example 6 | G2 | G4 | G5 |
| Comparative Example 7 | G2 | G2 | G5 |
| Comparative Example 8 | G2 | G4 | G5 |
| Comparative Example 9 | G4 | G5 | G5 |

From the above results, it is found that, in the examples, even when an image having a high image density is formed after repeatedly forming images having a low image density in a high temperature and high humidity environment, occurrence of passing of a toner from a cleaning nip portion is prevented, unlike the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles;

first silica particles having an average circularity of 0.9 to 1.0, a particle size distribution index of 1.05 to 1.25, and a compression aggregation degree of 60% to 95%; and second silica particles having an average circularity of 0.9 to 1.0, a particle size distribution index of 1.05 to 1.25, and a compression aggregation degree of 60% to 95%, wherein, when an average primary particle diameter of the first silica particles is set as Da (nm) and an average primary particle diameter of the second silica particles is set as Db (nm), relationships of the following Expressions (A1) to (A3) are satisfied:

$$80 \leq Da \leq 120, \quad \text{Expression (A1)}$$

$$120 \leq Db \leq 200, \text{ and} \quad \text{Expression (A2)}$$

$$10 \leq Db - Da \leq 120. \quad \text{Expression (A3)}$$

2. The electrostatic charge image developing toner according to claim 1, wherein, when the compression aggregation degree of the second silica particles is set as Ab (%) and a compression aggregation degree of mixed silica particles obtained by mixing the same amounts of the first silica particles and the second silica particles with each other is set as Aa+b (%), a relationship of the following Expression (B1) is satisfied:

$$Ab < Aa+b. \quad \text{Expression (B1)}$$

3. The electrostatic charge image developing toner according to claim 1, wherein, when a specific gravity of the hardened first silica particles is set as Sa ($g/cm^3$) and a specific gravity of the hardened second silica particles is set as Sb ($g/cm^3$), relationships of the following Expressions (C1) to (C3) are satisfied:

$$0.6 \leq Sa \leq 0.9, \quad \text{Expression (C1)}$$

$$0.5 \leq Sb \leq 0.8, \text{ and} \quad \text{Expression (C2)}$$

$$Sb < Sa. \quad \text{Expression (C3)}$$

4. The electrostatic charge image developing toner according to claim 1, wherein a total amount of the first silica particles and the second silica particles externally added is 0.5% by weight to 3.0% by weight with respect to the toner particles.

5. The electrostatic charge image developing toner according to claim 1, wherein a ratio of the amount of the first silica particles externally added to the amount of the second silica particles externally added (weight ratio: amount of the first silica particles externally added/amount of the second silica particles externally added) is 25/75 to 75/25.

6. The electrostatic charge image developing toner according to claim 1, wherein both of the first silica particles and the second silica particles are sol-gel silica particles.

7. The electrostatic charge image developing toner according to claim 1, wherein at least any one of the first silica particles and the second silica particles are particles in which surfaces of the silica particles are treated with a hydrophobizing agent.

8. The electrostatic charge image developing toner according to claim 7, wherein the hydrophobizing agent is an organic silicon compound.

9. The electrostatic charge image developing toner according to claim 1, wherein a volume average particle diameter (D50v) of the toner particles is from 4 μm to 8 μm.

10. The electrostatic charge image developing toner according to claim 1, wherein an average circularity of the toner particles is 0.950 to 0.990.

11. The electrostatic charge image developing toner according to claim 1, wherein the toner particles include a polyester resin.

12. The electrostatic charge image developing toner according to claim 11, wherein a compositional monomer of the polyester resin includes neopentyl glycol.

13. The electrostatic charge image developing toner according to claim 11, wherein a glass transition temperature (Tg) of the polyester resin is from 50° C. to 80° C.

14. The electrostatic charge image developing toner according to claim 11, wherein a weight average molecular weight (Mw) of the polyester resin is from 7,000 to 500,000.

15. The electrostatic charge image developing toner according to claim 1, further comprising:

at least one kind selected from the group consisting of resin particles and metallic soap particles.

16. The electrostatic charge image developing toner according to claim 15, wherein the resin particles are composed of polytetrafluoroethylene and the metallic soap particles are composed of zinc stearate.

17. An electrostatic charge image developer comprising:

the electrostatic charge image developing toner according to claim 1.

18. A toner cartridge comprising:

a container that contains the electrostatic charge image developing toner according to claim 1, wherein the toner cartridge is detachable from an image forming apparatus.

* * * * *